US006520467B2

(12) United States Patent
Thomas et al.

(10) Patent No.: US 6,520,467 B2
(45) Date of Patent: Feb. 18, 2003

(54) HAIR DRYER HOLDER

(76) Inventors: Anne Marie Thomas, One Wagon Trail Rd., Chelmsford, MA (US) 01824; Andrew P. Thomas, One Wagon Trail Rd., Chelmsford, MA (US) 01824

( * ) Notice: Subject to any disclaimer, the term of this patent is extended or adjusted under 35 U.S.C. 154(b) by 0 days.

(21) Appl. No.: 09/785,418

(22) Filed: Feb. 20, 2001

(65) Prior Publication Data

US 2001/0020668 A1 Sep. 13, 2001

Related U.S. Application Data

(63) Continuation-in-part of application No. 09/335,036, filed on Jun. 16, 1999, now Pat. No. 6,189,229.

(51) Int. Cl.[7] ..... F16M 11/00

(52) U.S. Cl. ..... 248/309.3; 248/188.2; 248/288.1

(58) Field of Search ..... 748/309.3, 288.1, 748/288.51, 206.2, 205.5, 181.1, 181.2; 34/90

(56) References Cited

U.S. PATENT DOCUMENTS

| | | | | | |
|---|---|---|---|---|---|
| 230,521 | A | * | 7/1880 | Barker | 15/144.2 |
| 2,015,280 | A | * | 9/1935 | Morishita | 248/103 |
| 2,711,872 | A | * | 6/1955 | Camplee | |
| 3,251,626 | A | * | 5/1966 | Martin | 248/103 |
| 4,225,106 | A | | 9/1980 | Eplan | 248/309 |
| 4,453,695 | A | | 6/1984 | Sennott et al. | 248/660 |
| 4,696,447 | A | * | 9/1987 | Strecker | 248/206.3 |
| 4,712,313 | A | | 12/1987 | Gettleman | 34/97 |
| 4,746,090 | A | | 5/1988 | Hamilton | 248/314 |
| D313,341 | S | | 1/1991 | Gaboriault et al. | D8/366 |
| D314,502 | S | | 2/1991 | Weldin | D8/373 |
| 5,040,709 | A | * | 8/1991 | Neugent | |
| 5,174,531 | A | | 12/1992 | Perakis | 248/124 |
| D374,312 | S | | 10/1996 | Edgar | D28/73 |
| 5,573,329 | A | * | 11/1996 | van Gennep | 248/229.13 |
| 5,613,305 | A | | 3/1997 | Narrin | 34/90 |
| 5,681,018 | A | * | 10/1997 | Hoftman | 248/125.8 |
| 5,842,670 | A | | 12/1998 | Nigoghosian | 248/160 |
| 5,857,263 | A | | 1/1999 | Chan | 34/97 |
| 5,937,537 | A | | 8/1999 | Miller | 34/97 |
| 5,956,861 | A | | 9/1999 | Barnes | 34/90 |
| 6,061,923 | A | | 5/2000 | Case | 34/90 |

* cited by examiner

*Primary Examiner*—Alvin Chin-Shue
(74) *Attorney, Agent, or Firm*—Pennie & Edmonds LLP

(57) ABSTRACT

A hair dryer holder for adjustably holding a hair dryer, comprising a base for attaching the hair dryer holder to a surface; an extension member including a bottom portion fixed to the base and an arm member extending from the base; and a cup member coupled to the arm member. The holder also includes a ball member disposed between the cup member and a plate member for rotation therein, the ball member is configured for coupling to a nozzle of a hair dryer such that the nozzle can be positioned by the ball member.

6 Claims, 4 Drawing Sheets

HAIR DRYER HOLDER

CROSS-REFERENCE TO RELATED APPLICATIONS

This application is a continuation-in-part of Application No. 09/335,036, filed Jun. 16, 1999 U.S. Pat. No. 6,189,229, issue Feb. 20, 2001, which is incorporated herein in its entirety by reference.

FIELD OF THE INVENTION

The present invention generally relates to a novel holder for adjustably holding a hair dryer.

BACKGROUND OF THE INVENTION

Hair dryers are well-known and widely-used appliances. Although hair dryers are used by millions of consumers everyday, they remain an awkward appliance to use simply because the user is generally using a brush and/or a comb concurrently. In order to simplify the use of hair dryers, many have attempted to create hair dryer holders to free the user's hands. However, because of the unusual and different shape of most hair dryers, the holders have not met the user's needs.

U.S. Pat. No. 4,225,106 discloses an apparatus for supporting an electrical hair dryer. The apparatus includes a bracket having an arm that pivots and a holder having a slot and a yoke that is pivotly attached to the arm. The dryer is supported in the holder by placing the hand grip of the dryer in the slot and the barrel of the dryer in the yoke. Resilient straps secure the dryer in place.

U.S. Pat. No. 4,712,313 discloses a portable hair dryer holder designed to hold a hair dryer, allowing a person to use their two free hands on their hair.

U.S. Pat. No. 4,746,090 discloses an adjustable holder device for a hand-held held hair dryer that allows rotational and vertical movement of the hair dryer. The device comprises a holder member that holds the hair dryer on one end and attaches to a base on the other end. A wall mount base is provided for permanent attachment to a wall that has a means for receiving the holder member in varying vertical positions.

U.S. Pat. No. 5,174,531 discloses a hair dryer holder apparatus that is fully adjustable for releasably holding a hair dryer. The holder includes a horizontal ring base and a pair of spaced vertical telescoping posts, the upper ends of which include a hinged pair of adjustable arms angled generally towards each other. The arms have grippers which releasably hold the hair dryer at the handle and the nozzle.

U.S. Pat. No. 5,842,670 discloses an apparatus for supporting an electrical hair dryer. The apparatus includes a base from which projects a flexible tube. The other end of the tube includes a hair dryer holder. The flexible tube may be positioned into any of a number of various orientations.

U.S. Pat. No. 5,857,263 discloses a hair drying apparatus comprising a hair dryer holder, a power cord retainer, and a base. The holder allows the hair dryer to be removable, adjustable in height, and securably positioned. The base contains a power cord retainer and may be mounted on a wall.

U.S. Pat. Nos. Des. 313,341 and Des. 374,312 disclose various designs for a hair dryer holder. U.S. Pat. No. Des. 314,502 discloses a design for an adjustable hair dryer holder.

Although there are numerous means for holding a hair dryer disclosed in the art, there remains a need for a hair dryer holder that allows universal mounting (e.g., a wall, a mirror, a table, or a sink) while simultaneously providing a universal range of positions available for securing the hair dryer.

SUMMARY OF THE INVENTION

The present invention is directed to a hair dryer holder for adjustably holding a hair dryer, including a base for attaching the hair dryer holder to a surface; an extension member including a bottom portion fixed to the base and an arm member extending from the base; and a ball joint member coupled to the arm member and comprising a ball member disposed between a cup member and a plate member for rotation therein, the ball member configured for coupling to a nozzle of a hair dryer such that the nozzle can be positioned by the ball member.

In one embodiment, the ball member has an aperture of a first diameter such that the ball member has at least 15 degrees of rotation within the cup member and the plate member when a hair dryer is secured thereto. In a preferred embodiment, the ball aperture has about 15 to 35 degrees of rotation. Preferably, the ball joint member is integral with the arm member.

In another embodiment, the base is releasably attached to the surface. In yet another embodiment, the base is portable by a user for use at different locations. Preferably, the ball joint member has at least about 180 degrees of rotation in a first plane. Additionally, it is preferred that the extension member is coupled to the base such that it has at least about 180 degrees of rotation in a second plane substantially perpendicular to the first plane. In a preferred embodiment, the ball joint member has at least about 180 to 270 degrees of rotation.

The base may be a suction cup, a c-clamp, a mounting plate, a clamp, a weighted base, or a telescoping stand and base. Preferably, the base is a suction cup. In still another embodiment, the ball member further includes an extension member and an adjustable clamp for receiving the nozzle of a hair dryer, wherein the extension member is juxtaposed between the clamp and ball member.

DESCRIPTION OF THE PREFERRED EMBODIMENTS

Figure 1:
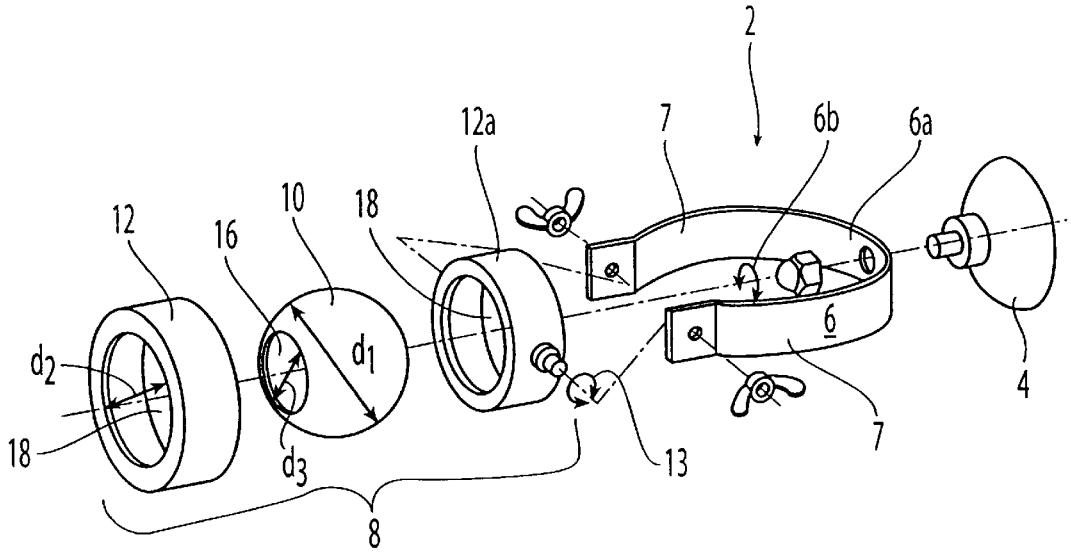
FIG. 1 is an exploded perspective view of the components that comprise a preferred embodiment of the hair dryer holder according to the present invention.
Figure 2:
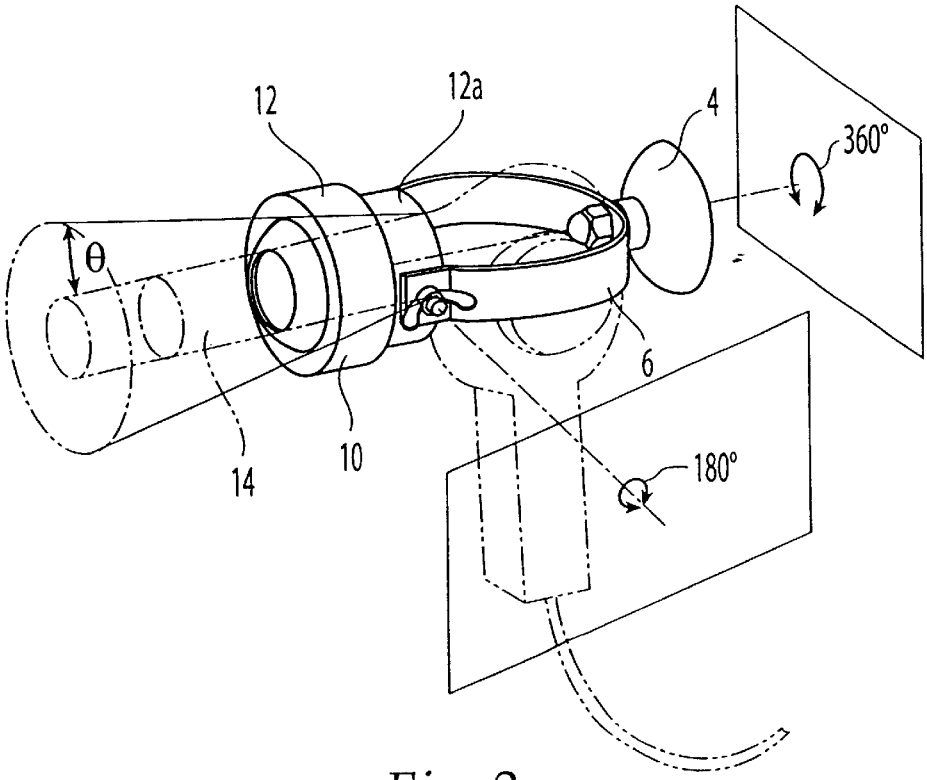
FIG. 2 is a view of the components of FIG. 1 in assembled position with a hair dryer (in phantom outline) held in place therein.

Referring to FIGS. 1 and 2, the present invention is directed to a hair dryer holder 2 and a means for adjustably holding a hair dryer, comprising a base 4 for attaching the hair dryer holder to a surface, an extension member 6 including a bottom portion 6*a* secured to the base and two arm members 7 extending from the base. A universal joint member 8 is coupled between the arm members and comprises a ball member 10 juxtaposed between two cup members 12 and 12*a* for rotation therein, the ball member having a ball aperture 16 for receiving a nozzle of a hair dryer 14.

The base 4 of the hair dryer holder 2 comprises any means that allows secure, but preferably removable, attachment of the holder to any one of a number of surfaces or structures, e.g., a counter top, a mirror, a wall, or a sink. The base 4, for example, might comprise a suction cup, a c-clamp, a mounting plate, a clamp, a telescoping stand and weighted base, or a combination thereof. Preferably, the base 4 of the hair dryer holder 2 is a suction cup that allows releasable attachment to a variety of surfaces.

Attached to the base 4 is an extension member 6 that preferably includes a bottom portion 6*a* secured to the base 4 and, additionally, at least one arm member 7 and, preferably, two arm members 7 extending away from the base 4. The extension member 6 is preferably securely attached to the base 4 via means such as the combination of a bolt and a wing nut or a nut. The extension member 6 is preferably attached in a manner that allows swivelling of the member about the central axis through the base 4, as indicated by arrow 6*b*. The two arm members 7 should extend away from the base 4 at least a distance far enough to allow positioning of a universal joint member 8 coupled between the arm members 7 for receiving a hair dryer 14. The extension member 6 may be of unitary or multi-component construction and may be any one of a number of shapes, e.g., U-shaped, horseshoe-shaped, or V-shaped, or materials, e.g., metal, plastic or polymeric, or hard rubber. The extension member 6 is preferably a light-weight metal, U-shaped, and of unitary construction.

The universal joint member 8 is coupled between the arm members 7 and acts to receive a hair dryer 14 and to provide a means for rotation and securing of the hair dryer 14 position. The universal joint member 8 is coupled to the arm member 7 using any one of a number of means, such as screws, rivets, or bolts with nuts or wing nuts, and preferably rotates relative to the member, i.e., around the axis connecting it to the arm members 7, as indicated by arrow 13. The rotatability of the extension member 6 about the base and the universal joint member 8 about the arm members 7, as indicated in FIG. 1 by rotation in the direction of arrows 6*b* and 13, respectively, provide a universal-type connection between these components. This enables the nozzle of a hair dryer 14, positioned in the holder 2, to assume a wide range of universally-variable positions, from which hot air is optimally aimed at the user's hair. Preferably, the universal joint member 8 is secured with wing nuts that allow it to be lockable in any predetermined position. The universal joint member 8 can rotate at least about 180 degrees, such that the nozzle of the hair dryer can at least point in either direction along the axis extending from the base. Preferably, the universal joint member 8 can rotate about 180 to 270 degrees.

Preferably, the universal joint member 8 comprises a ball member 10 juxtaposed between two cup members 12 and 12*a*. The ball member 10, which contains an aperture 16 for receiving the hair dryer 14, has a diameter, $d_1$, and may be constructed with any one of numerous flexible materials, such as rubber, plastic, or an elastomeric material. Preferably, the ball member 10 comprises an elastomeric material such that the ball aperture 16 is flexible enough to fit different diameter hair dryer nozzles. The material of the ball member 10 must be sufficiently heat-resistant so as to not be altered in shape or composition by the heat given off by the hair dryer 14.

The cup members 12 and 12*a* are preferably constructed of a material that cooperates with the material of the ball member 10 to minimize frictional resistance and allow for rotation of the ball member 10 within the cup members 12 and 12*a*. The cup members 12 and 12*a* may be of a material comprising metal, plastic, hard rubber, a thermoset material, or a combination thereof. The cup members 12 and 12*a* both include apertures 18 having a diameter, $d_2$, and the ball member 10 includes an aperture 16 having a diameter, $d_3$. The second diameter, $d_2$, is sufficiently smaller than the first diameter, $d_1$, such that the ball member 10 has at least about 15 degrees of rotation ($\theta$) about an axis extending from the base 4 of the holder 2 (See, e.g., FIGS. 1 and 2), within the cup members 12 and 12*a* when a hair dryer 14 is secured by their combination. The cup members 12 and 12*a* do not necessarily have the same aperture diameter in order to allow for rotation of the ball member 10. For example, the cup member 12*a* that is coupled to the arm members 7 could have a smaller diameter than the aperture in cup member 12, but the aperture diameter must still be larger than the diameter, $d_3$, of the aperture 16 in ball member 10 such that the ball member 10, when secured with the nozzle of the hair dryer 14, still allows for rotation within the two cup members 12 and 12*a*. Additionally, the diameter, $d_1$, of the ball member 10 is preferably greater than the apertures 18 of the cup members 12 and 12*a* such that it is contained within said members. The ball member 10, when holding a hair dryer, precesses about the central axis of the holder 2 (as indicated by arrow 6b in FIG. 1) by at least about 15 degrees (See $\theta$ in FIG. 2). Preferably, the ball member 10 has at about 15 to 35 degrees of rotation, about the central axis of the holder 2.

Figure 3:
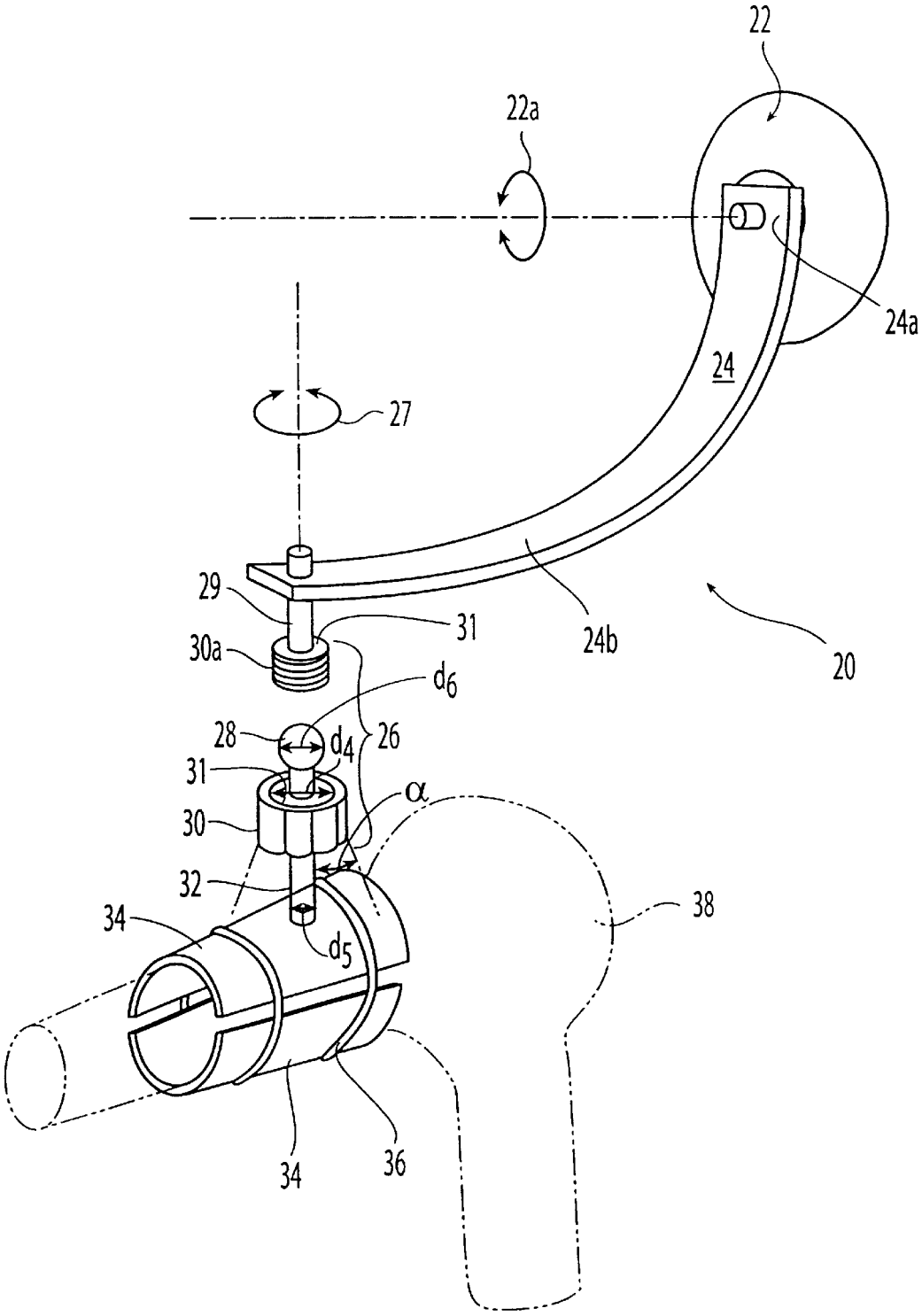
FIG. 3 is an exploded perspective view of a second embodiment of the hair dryer holder according to the present invention.

Referring to FIG. 3, another embodiment of the present invention is directed to a hair dryer holder 20 and a means for adjustably holding a hair dryer, comprising a base 22 for attaching the hair dryer holder to a surface, an extension member 24 including a bottom portion 24*a* secured to the base, and an arm member 24*b* extending from the base. A universal joint member 26 is coupled to the arm member and comprises a ball member 28 juxtaposed between two cup members 30 and 30*a* for rotation therein.

The base 22 of the hair dryer holder 20 comprises any means that allows secure, but preferably removable, attachment of the holder to any one of a number of surfaces or structures, e.g., a counter top, a mirror, a wall, or a sink. The base 22, for example, might comprise a suction cup, a c-clamp, a mounting plate, a clamp, a telescoping stand and weighted base, or a combination thereof. Preferably, the base 22 of the hair dryer holder 20 is a suction cup that allows releasable attachment to a variety of surfaces.

Attached to the base 22 is an extension member 24 that preferably includes a bottom portion 24*a* secured to the base 22 and, additionally, at least one arm member 24*b* extending away from the base 22. The extension member 24 is preferably securely attached to the base 22 via means such as the combination of a bolt and a wing nut or a nut. The extension member 24 is preferably attached in a manner that allows swivelling of the member about the central axis through the base 22, as indicated in FIG. 3 by arrow 22*a*. The arm member 24*b* should extend away from the base 22 at least a distance far enough to allow positioning of a universal joint member 26 coupled to the arm member 24*b* for coupling to a hair dryer 38. The extension member 24 may be a unitary arm of a multi-component construction. Preferably, the extension member 24 is a curved arm such that a line tangent to one end is approximately perpendicular to a line tangent to the opposite end. The arm can be made from any sufficiently strong material, e.g., metal, plastic or polymeric, or hard rubber. The extension member 24 is preferably a light-weight metal, partial C-shaped, and of unitary construction.

The universal joint member 26 is coupled to the arm member 24*b* by connector 29 and acts to provide a means for rotation. The connector 29 is coupled to the arm member 24*b* using any one of a number of means, such as screws, rivets, or bolts with nuts or wing nuts, and preferably rotates relative to the member, e.g., around the axis connecting it to the arm member 24*b*, as indicated in FIG. 3 by arrow 27. The rotatability of the extension member 24 about the base 22, and the universal joint member 26 about the arm member 24*b*, allows rotation in the direction of arrows 22*a* and 27, respectively, providing a universal-type connection between these components. This enables the universal joint member 26 to assume a wide range of universally-variable positions, from which the hot air of an attached hair dryer 38 is optimally aimed at the user's hair. Preferably, the universal joint member 26 is secured with wing nuts that allow it to be lockable in any predetermined position. The universal joint member 26 can rotate about 360 degrees about the axis co-linear to connector 29 (See arrow 27, FIG. 3).

Preferably, the universal joint member 26 comprises a ball member 28 juxtaposed between two cup members 30 and 30*a*. The ball member 28, which includes a clamp extension 32 and nozzle clamp 34 for receiving the hair dryer 38, may be constructed with any one of numerous flexible materials, such as rubber, plastic, or an elastomeric material.

The cup members 30 and 30*a* are preferably constructed of a material harder than the material of the ball member 28 to minimize frictional resistance and allow for rotation of the ball member 28 within the cup members 30 and 30*a*. The cup members 30 and 30*a* may be of a material comprising metal, plastic, hard rubber, a thermoset material, or a combination thereof. The cup members 30 and 30*a* both include apertures 31 having a diameter, $d_4$, and the clamp extender 32 has a diameter, $d_5$. The diameter, $d_5$, of the clamp extender 32 is sufficiently smaller than the aperture diameter, $d_4$, of the cup members 30 and 30*a* such that the ball member 28 has at least about 15 degrees of rotation (a), away from and about an axis co-linear to the connector 29 (See arrow 27, FIG. 3) within the cup members 30 and 30*a*. The cup members 30 and 30*a* do not necessarily have the same aperture diameter in order to allow for rotation of the ball member 28. For example, the cup member 30*a* that is coupled to the arm member 24*b* via the connector 29 could have a smaller diameter than the aperture in cup member 30, but should remain larger than the diameter of the clamp extender 32 to allow for the desired rotation within the cup members 30 and 30*a*. Additionally, the ball member 28 has a diameter, $d_6$, that is greater than the aperture 31 of the cup members 30 and 30*a* such that the ball member 28 is contained within said members. The ball member 28, precesses about the axis co-linear to connector 29 (See arrow 27, FIG. 3) by at least about 15 degrees ($\alpha$).

The clamp extender 32 is connected to the nozzle clamp 34, preferably a hollow cylinder divided along its longitudinal axis, the two halves of the cylinder held together about the nozzle of the hair dryer 38 by an adjustable means, e.g. elastic bands, O-rings, velcro straps, or cable ties. Preferably, the nozzle clamp is held together with a plurality of O-rings 36. The adjustable means should be strong enough as to securely hold the hair dryer within the clamp 34 and flexible enough to allow stretching such that a range of nozzle sizes may be held. Preferably, the nozzle clamp 34 comprises a material that is sufficiently heat-resistant so as to not be altered in shape or composition by the heat given off by the hair dryer 38.

Figure 4:
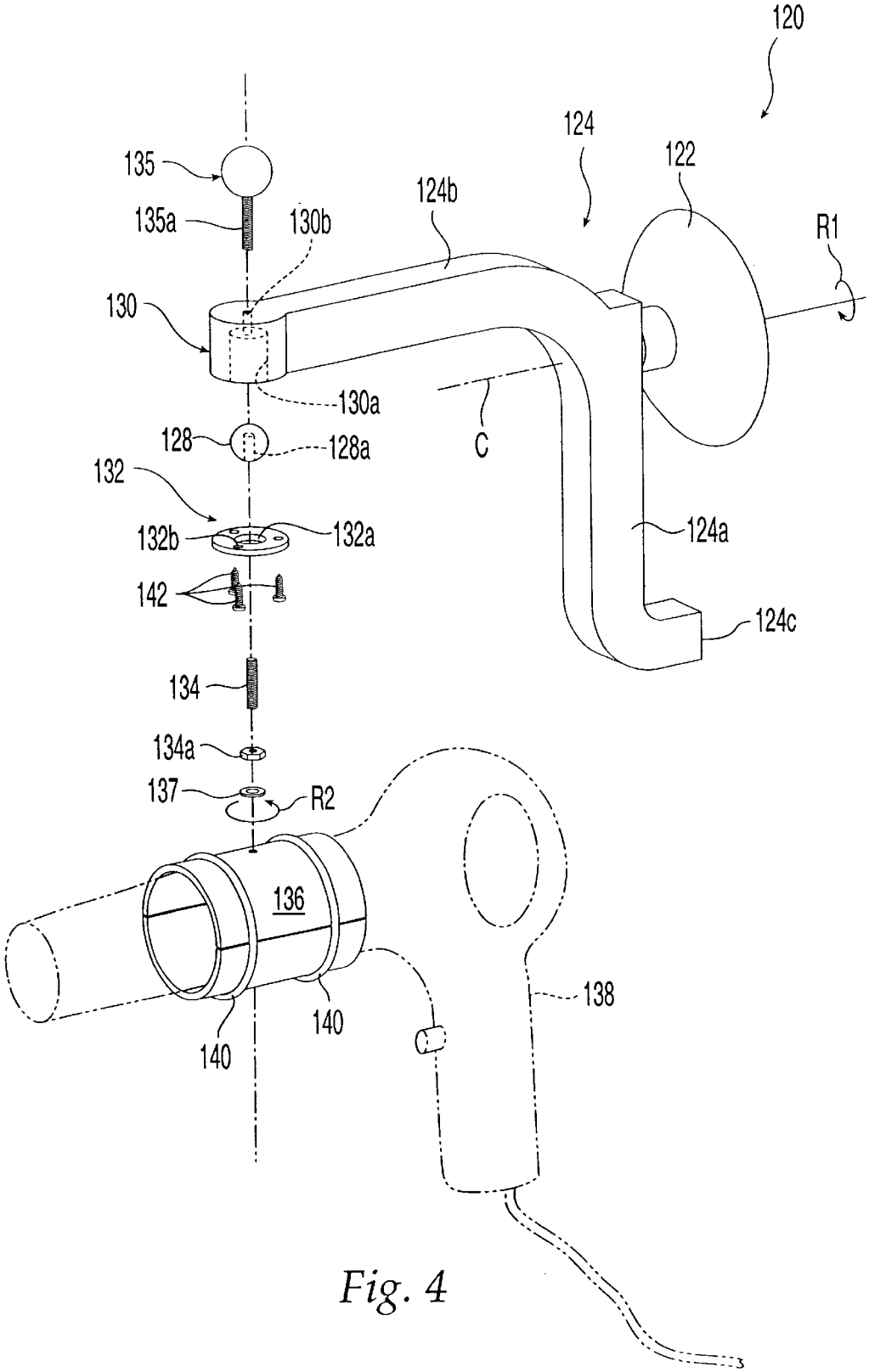
FIG. 4 is an exploded top perspective view of a third embodiment of the hair dryer holder of the present invention.
Figure 5:
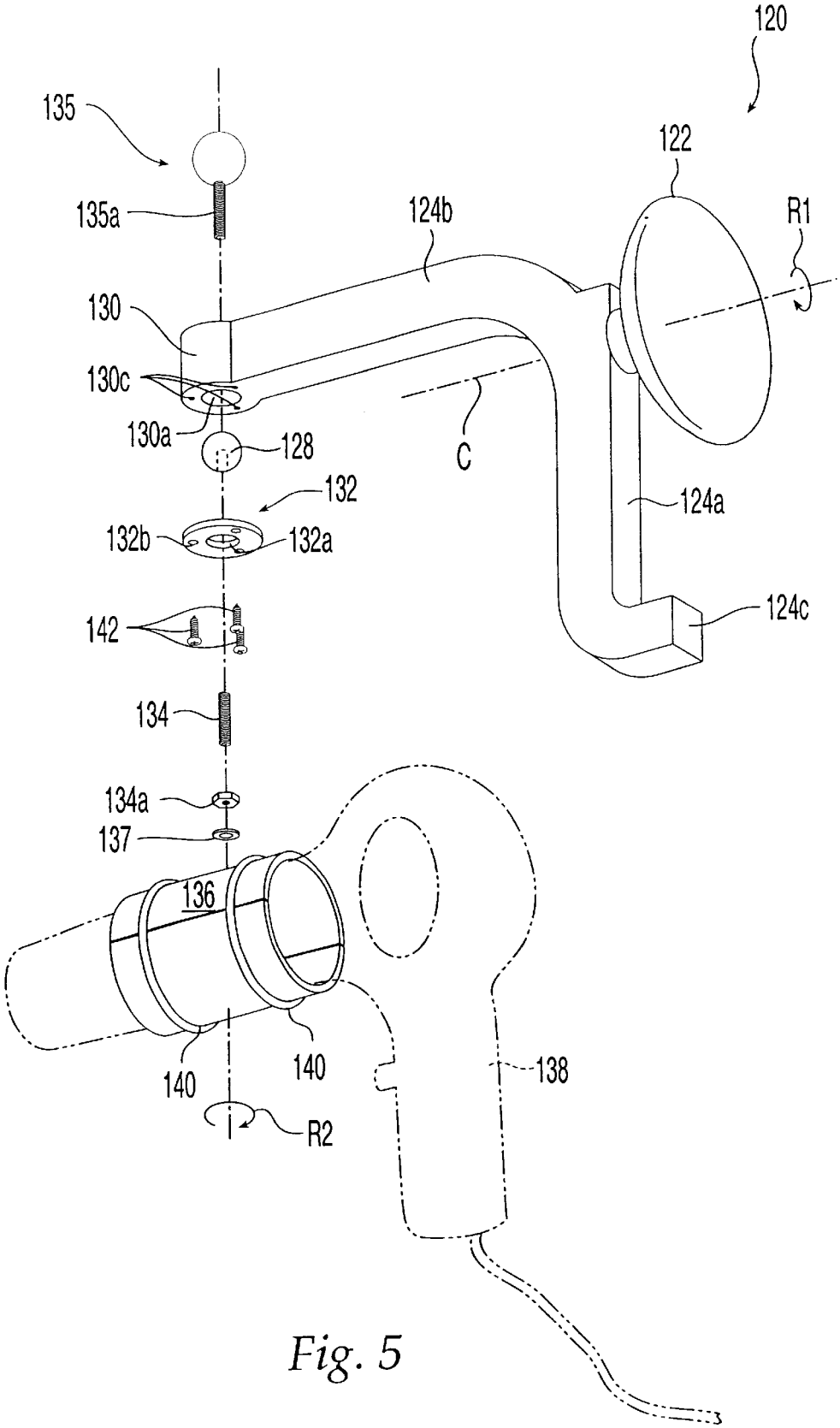
FIG. 5 is an exploded bottom perspective view of a third embodiment of the hair dryer holder of the present invention.

Referring to FIGS. 4–5, another embodiment of the present invention is directed to a hair dryer holder 120 and a means for adjustably holding a hair dryer, comprising a base 122 for attaching the hair dryer holder to a surface, an extension member 124 including a bottom portion 124*a* secured to the base, and an arm member 124*b* extending from the base. A cup member or ball joint receiver 126 is coupled to the arm member 124*b* and includes a socket with an enlarged portion 130*a* for receiving a ball member 128 and a narrow portion 130*b*. The ball member 128 is juxtaposed between cup member 130 and a cup member 132 for rotation therein.

The base 122 of the hair dryer holder 120 comprises any means that allows secure, but preferably removable, attachment of the holder to any one of a number of surfaces or structures, e.g., a counter top, a mirror, a wall, or a sink. The base 122, for example, might comprise a suction cup, a c-clamp, a mounting plate, a clamp, a telescoping stand and weighted base, or a combination thereof. Preferably, the base 122 of the hair dryer holder 120 is a suction cup that allows releasable attachment to a variety of surfaces.

The extension member 124 is preferably attached to the base 122 in a manner that allows rotation or swivelling of the member 124 about the central axis C through the base 122, as indicated in FIG. 4 by arrow R1. The arm member 124*b* should extend away from the base 122 at least a distance far enough to allow positioning of the cup member 130 coupled to the arm member 124*b* for coupling to a hair dryer 138. The cup member 132 is preferably an annular plate. The extension member 124 may be a unitary arm of a multi-component construction. Preferably, the extension member 124 is a curved arm and the bottom portion 124*a* is configured to include end 124*c* that abuts the mounting surface providing support for the hair dryer holder 120. The arm can be made from any sufficiently strong material, e.g., metal, plastic or polymeric, or hard rubber. The extension member 124 is preferably plastic and of unitary construction.

The cup member 130 is preferably unitary in construction with the arm member 124*b*. In one embodiment, the cup member 130 is coupled to the arm member 124*b* in a manner that provides a means for rotation. The rotatability of the extension member 124 about the base 122, and the cup member 130 about the arm member 124*b*, allows rotation in the direction of arrow R1.

Preferably, the ball member 128 is juxtaposed between the socket 130*a* and the cup member 132. The ball member 128, preferably includes a threaded bore 128*a*. The bore 128*a* extends partially into the ball and receives a threaded extension member 134. The narrow socket portion 130*b* receives threaded portion 135*a* of retainer 135. The extension member 134 may be secured to a nozzle clamp 136 by a fastener such as a nut 134*a*. Optionally, a washer 137 can be disposed between nut 134*a* and clamp 136.

The socket 130*a* and the cup member or plate 132 are preferably constructed of materials of sufficient hardness to minimize frictional resistance and allow for rotation of the ball member 128 within the socket 130*a* and the cup member 132. The cup member 130, ball member 128, and the cup member 132 may be of materials comprising metal, plastic, hard rubber, a thermoset material, or a combination thereof.

The socket 130*a* preferably has a diameter sufficient to allow free rotation of ball member 128 and a radius of curvature about the sides substantially the same as the ball member 128. The ball member 128 may be secured in any predetermined position by a securing means, such as retainer or set screw 135.

The cup member 132 is secured to the ball joint member 126 and preferably includes an aperture 132*a* having a diameter sufficiently smaller than diameter of the ball member 128 such that the ball member 128 is contained within the socket 130*a* and the plate member 132. The aperture 132*a* is preferably large enough to allow the extender 134 to pass therethrough and allow at least about 15 degrees of rotation, away from and about an axis co-linear to the extender 134, within socket 130*a* and plate member 132, as shown by arrow R2. With rotation R1 and R2, the holder 120 allows a universal-type connection between the components. This enables the hair dryer 138 to assume a wide range of universally-variable positions.

The cup member or plate 132 also includes three apertures 132*b* that align with apertures 130*c* in cup member 130. These apertures 130*b* and 132*b* receives fastners 142 to secure plate member 132 to cup member 130. Other techniques can be used to secure these members, such as adhesive and the like.

The clamp extender 134 is connected to the nozzle clamp 136 in an adjustable manner. Preferably the nozzle clamp 134 is a hollow cylinder divided along its longitudinal axis, the two halves of the cylinder held together about the nozzle of the hair dryer 138 by an adjustable means, e.g. elastic bands, o-rings, velcro straps, or cable ties. Preferably, the nozzle clamp is held together with a plurality of o-rings 140. The adjustable means should be strong enough as to securely hold the hair dryer within the clamp 136 and flexible enough to allow stretching such that a range of nozzle sizes and shapes (i.e, tapered or varying diameter) may be held. Preferably, the nozzle clamp 136 comprises a material that is sufficiently heat-resistant so as to not be altered in shape or composition by the heat given off by the hair dryer 138.

When the screw 135 is rotated so that the threaded portion 135*a* extends into the recess 130*a* and firmly contacts the ball member 128, the ball member 128 and consequently the clamp 136 cannot rotate. As a result, the retainer secures the hair dryer 138 in the selected position.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. For example, features of one embodiment can be incorporated with features of any other embodiment. Indeed, various modifications of the invention in addition to those shown and described herein will become apparent to those skilled in the art from the foregoing description. Such modifications are also intended to fall within the scope of the appended claims.

What is claimed:

1. A hair dryer holder for adjustably holding a hair dryer, comprising:

a releasable-attachable base for attaching the holder to a flat surface;

an extension arm rotatably attached to said base, wherein said extension arm comprises a first extension member, a second extension member, and a third extension member, each of said first, second, and third extension members having a first end and a second end;

wherein said first extension member is configured to be substantially perpendicular to a flat surface when said base is attached thereto and extending in a first direction, a cup member is coupled to said first end of said first extension member, a ball member is disposed between the cup member and a plate member, and at least one of said cup member, ball member and plate member is coupled to a fourth extension member, wherein said first end of said second extension member is coupled to said second end of said first extension member and said second extension member is substantially perpendicular to said first extension member, is rotatably attached to said base, and is configured to be substantially parallel to said flat surface when said base is attached thereto, and wherein said first end of said third extension member is coupled to said second end of said second extension member and extending substantially parallel to said first extension member in a second direction substantially opposite said first direction and is configured to abut said flat surface when said base is attached thereto; and wherein said fourth extension member is coupled to clamp means for holding a hair dryer nozzle.

2. The hair dryer holder of claim 1, wherein said extension arm is a curved arm.

3. The hair dryer holder of claim 1, wherein said extension arm is monolithic.

4. The hair dryer holder of claim 1, wherein said clamp means comprises a hollow cylinder.

5. The hair dryer holder of claim 4, wherein said cylinder is divided along its longitudinal axis.

6. The hair dryer holder of claim 1, wherein said clamp means is held together with a plurality of O-rings.

* * * * *